US010000971B2

(12) United States Patent
Diaz

(10) Patent No.: US 10,000,971 B2
(45) Date of Patent: Jun. 19, 2018

(54) STEERING TOOL WITH ECCENTRIC SLEEVE AND METHOD OF USE

(71) Applicant: Halliburton Energy Services, Inc., Houston, TX (US)

(72) Inventor: Excelino Diaz, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 290 days.

(21) Appl. No.: 14/784,014

(22) PCT Filed: May 9, 2013

(86) PCT No.: PCT/US2013/040254
§ 371 (c)(1),
(2) Date: Oct. 12, 2015

(87) PCT Pub. No.: WO2014/182303
PCT Pub. Date: Nov. 13, 2014

(65) Prior Publication Data
US 2016/0053543 A1 Feb. 25, 2016

(51) Int. Cl.
*E21B 17/20* (2006.01)
*E21B 7/04* (2006.01)
(Continued)

(52) U.S. Cl.
CPC ..... *E21B 7/04* (2013.01); *E21B 3/00* (2013.01); *E21B 7/062* (2013.01); *E21B 17/20* (2013.01)

(58) Field of Classification Search
CPC ... E21B 7/04; E21B 3/00; E21B 7/062; E21B 17/20
See application file for complete search history.

(56) References Cited

U.S. PATENT DOCUMENTS 2,498,192 A 2/1950 Wright
5,755,298 A 5/1998 Langford, Jr. et al.
(Continued)

FOREIGN PATENT DOCUMENTS

WO 03102353 A1 12/2003
WO 2010107606 A2 9/2010
WO 2012158144 A1 11/2012

OTHER PUBLICATIONS

European Search Report dated Dec. 6, 2016; European Patent Application No. 13883925.3.
(Continued)

*Primary Examiner* — Benjamin F Fiorello
(74) *Attorney, Agent, or Firm* — McGuireWoods LLP

(57) ABSTRACT

A method for steering a well comprises disposing a first orienting assembly and a second orienting assembly spaced apart along a circular inner peripheral surface of a housing. An orienting sleeve is rotatably supported between the first orienting assembly and the second orienting assembly, The orienting sleeve has an angled bore therethrough, wherein a first longitudinal axis of the angled bore is inclined by a predetermined angle to a second longitudinal axis referenced to a cylindrical outer peripheral surface of the orienting sleeve. A rotatable steering shaft is rotatably supported along the angled bore to control rotatable steering shaft bending. The rotation of the first orienting assembly, the second orienting assembly, and the orienting sleeve is controllably adjusted to control the steering direction of the rotatable steering shaft.

10 Claims, 5 Drawing Sheets

(51) Int. Cl.
*E21B 7/06* (2006.01)
*E21B 3/00* (2006.01)

(56) References Cited

U.S. PATENT DOCUMENTS

| | | | | |
|---|---|---|---|---|
| 6,059,050 | A * | 5/2000 | Gray | E21B 7/068 175/73 |
| 9,556,678 | B2 * | 1/2017 | Schaaf | E21B 7/06 |
| 2005/0247489 | A1 * | 11/2005 | Jamieson | E21B 7/062 175/263 |
| 2007/0181343 | A1 * | 8/2007 | Russell | E21B 7/068 175/74 |
| 2011/0284292 | A1 | 11/2011 | Gibb et al. | |

OTHER PUBLICATIONS

International Search Report and Written Opinion dated Sep. 4, 2013; PCT Inetrantional Application No. PCT/US2013/040254.

* cited by examiner

STEERING TOOL WITH ECCENTRIC SLEEVE AND METHOD OF USE

BACKGROUND OF THE DISCLOSURE

The present disclosure relates generally to the field of drilling welts and more particularly to steerable drilling tools.

In deviated and horizontal drilling applications it is advantageous to use rotary steerable systems to prevent pipe sticking in the deviated and horizontal sections. It is advantageous to have the drill string rotating to prevent differential sticking and to reduce friction with the borehole wall. The rotary steerable system may have a housing that is substantially non-rotating. The present disclosure describes a downhole adjustable bent housing for rotary steerable drilling.

Directional drilling involves varying or controlling the direction of a wellbore as it is being drilled. Usually the goal of directional drilling is to reach or maintain a position within a target subterranean destination or formation with the drilling string. For instance, the drilling direction may be controlled to direct the wellbore towards a desired target destination, to control the wellbore horizontally to maintain it within a desired payzone or to correct for unwanted or undesired deviations from a desired or predetermined path.

Thus, directional drilling may be defined as deflection of a wellbore along a predetermined or desired path in order to reach or intersect with, or to maintain a position within, a specific subterranean formation or target. The predetermined path typically includes a depth where initial deflection occurs and a schedule of desired deviation angles and directions over the remainder of the wellbore. Thus, deflection is a change in the direction of the wellbore from the current wellbore path.

It is often necessary to adjust the direction of the wellbore frequently while directional drilling, either to accommodate a planned change in direction or to compensate for unintended or unwanted deflection of the wellbore. Unwanted deflection may result from a variety of factors, including the characteristics of the formation being drilled, the makeup of the bottomhole drilling assembly and the manner in which the wellbore is being drilled.

Deflection is measured as an amount of deviation of the wellbore from the current wellbore path and is expressed as a deviation angle or hole angle. Commonly, the initial wellbore path is in a vertical direction. Thus, initial deflection often signifies a point at which the wellbore has deflected off vertical. As a result, deviation is commonly expressed as an angle in degrees from the vertical.

Figure 1:
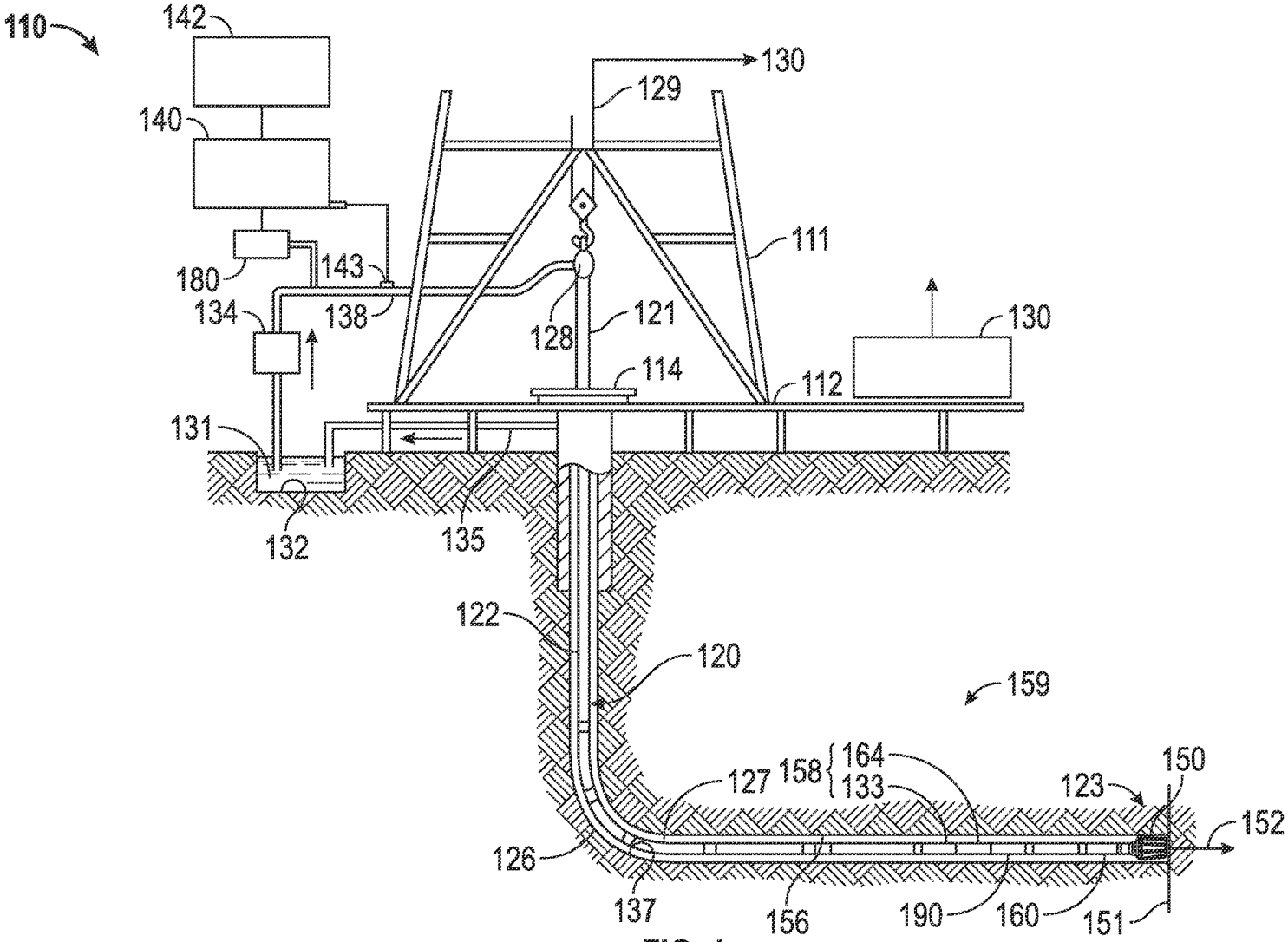
FIG. 1 shows a schematic diagram of a drilling system.

While the disclosed embodiments are susceptible to various modifications and alternative forms, specific embodiments thereof are shown by way of example in the drawings and will herein be described in detail. It should be understood, however, that the drawings and detailed description herein are not intended to limit the disclosed subject matter to the particular form(s) disclosed, but on the contrary, the intention is to cover all modifications, equivalents and alternatives falling within the scope of the present disclosure as defined by the appended claims.

DETAILED DESCRIPTION

The illustrative embodiments described below are meant as examples and not as limitations on the claims that follow.

FIG. 1 shows a schematic diagram of a drilling system 110 having a downhole assembly according to one embodiment of the present disclosure. As shown, the system 110 includes a conventional derrick 111 erected on a derrick floor 112, which supports a rotary table 114 that is rotated by a prime mover (not shown) at a desired rotational speech. A drill string 120 that includes a drill pipe section 122 extends downward from rotary table 114 into a directional borehole 126, also called a wellbore. Borehole 126 may travel in a three-dimensional path. The three-dimensional direction of the bottom 151 of borehole 126 is indicated by a pointing vector 152. A drill bit 150 is attached to the downhole end of dull string 120 and disintegrates the geological formation 123 when drill bit 150 is rotated. The drill string 120 is coupled to a drawworks 130 via a kelly joint 121, swivel 128, and line 129 through a system of pulleys (not shown). During the drilling operations, drawworks 130 may be operated to control the weight on bit 150 and the rate of penetration of drill string 120 into borehole 126. The operation of drawworks 130 is well known in the art and is thus not described in detail herein.

During drilling operations a suitable drilling fluid (commonly referred to in the art as "mud") 131 from a mud pit 132 is circulated under pressure through drill string 120 by a mud pump 134. Drilling fluid 131 passes from mud pump 134 into drill string 120 via fluid line 138 and kelly joint 121. Drilling fluid 131 is discharged at the borehole bottom 151 through an opening in drill bit 150. Drilling fluid 131 circulates uphole through the annular space 127 between drill string 120 and borehole 126 and is discharged into mud pit 132 via a return line 135. A variety of sensors (not shown) may be appropriately deployed on the surface according to known methods in the art to provide information about various drilling-related parameters, such as fluid flow rate, weight on bit, hook load, etc.

A surface control unit 140 may receive communications, via a telemetry link, from downhole sensors and devices. The communications may be detected by a sensor 143 placed in fluid line 138 and processed according to programmed instructions provided to surface control unit 140. Surface control unit 140 may display desired drilling parameters and other information on a display/monitor 142 which may be used by an operator to control the drilling operations. Surface control unit 140 may contain a computer, memory for storing data and instructions, a data recorder and other peripherals. Surface control unit 140 may also include well plan and evaluation models and may process data according to programmed instructions, and respond to user commands entered through a suitable input device, such as a keyboard (not shown).

In one example, a steerable drilling bottom hole assembly (BHA) 159 may comprise dill collars and/or drill pipe, a measurement while drilling system 158, and a steerable assembly 160. MWD system 158 comprises various sensors to provide information about the formation 123 and downhole drilling parameters. MWD sensors 164 in BHA 159 may include, but are not limited to, a device for measuring the formation resistivity near the drill bit a gamma ray device for measuring the formation gamma ray intensity, devices for determining the inclination and azimuth of the drill string, and pressure sensors for measuring, drilling, fluid pressure downhole. The above-noted devices may transmit data to a downhole transmitter 133, which in turn transmits the data uphole to the surface control unit 140, via sensor 143. In one embodiment, a mud pulse telemetry technique may be used to communicate data from downhole sensors and devices during drilling operations. A pressure transducer 143 placed in the mud supply line 138 detects mud pulses representative of the data transmitted by the downhole transmitter 133. Transducer 143 generates electrical signals in response to the mud pressure variations and transmits such signals to surface control unit 140. Alternatively, other telemetry techniques such as electromagnetic and/or acoustic techniques or any other suitable technique known in the art may be utilized. In one embodiment, hard-wired drill pipe may be used to communicate between the surface and downhole devices. In one example, combinations of the techniques described may be used. In one embodiment, a surface transmitter 180 transmits data and/or commands to the downhole tools using an of the transmission techniques described, for example a mud pulse telemetry technique. This may enable two-way communication between surface control unit 140 and a downhole controller 601 described below.

BHA 159 may also comprise a steerable assembly 160 for directing a steering shaft 75 attached between the rotating BHA 159 and hit 150 along the desired direction to steer the path of the well.

Figure 2A:
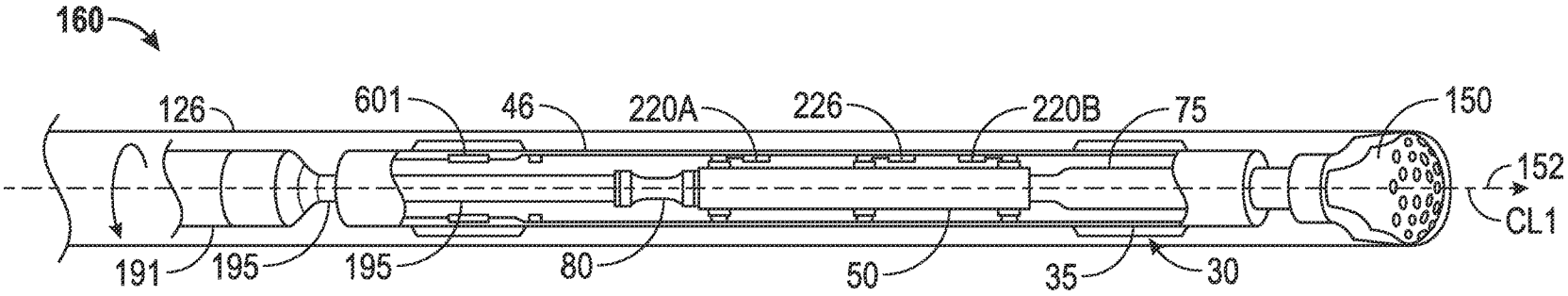
FIG. 2A shows a steerable drilling assembly.
Figure 2B:
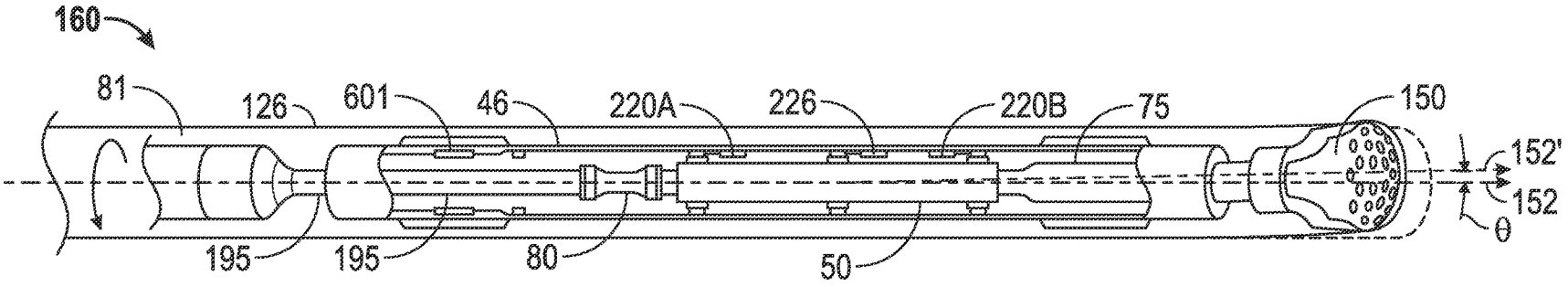
FIG. 2B shows the steerable drilling, assembly of FIG. 2 with a deviated steering shaft for altering the drilling direction.
Figure 3A:
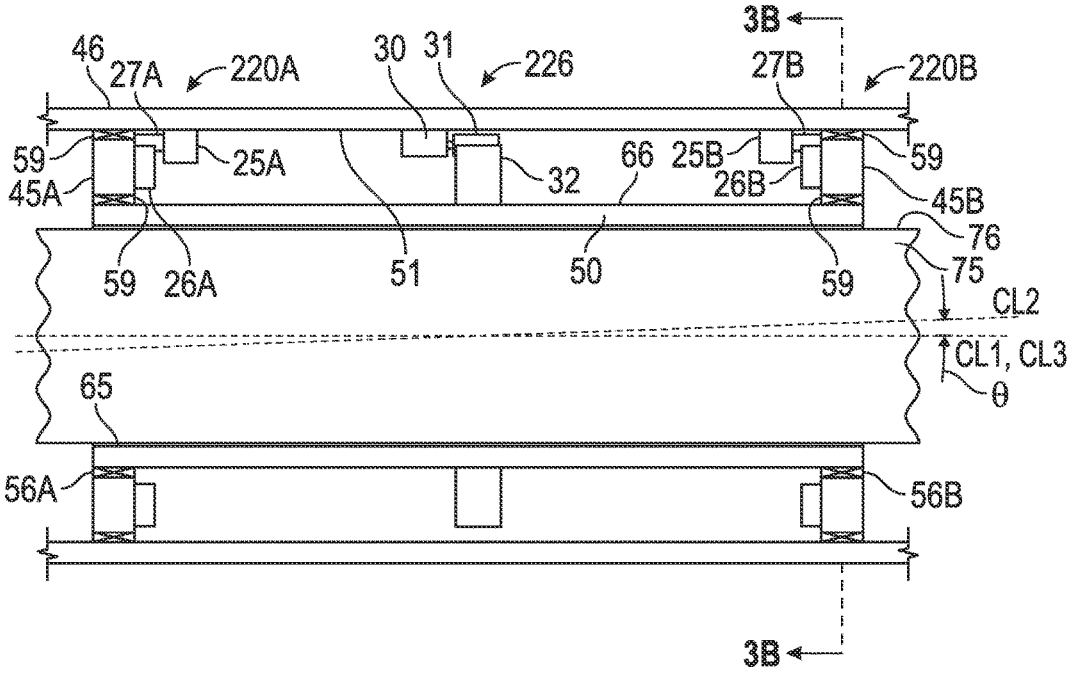
FIG. 3A shows a section of the steerable assembly with the steering shaft aligned with the housing.
Figure 3B:
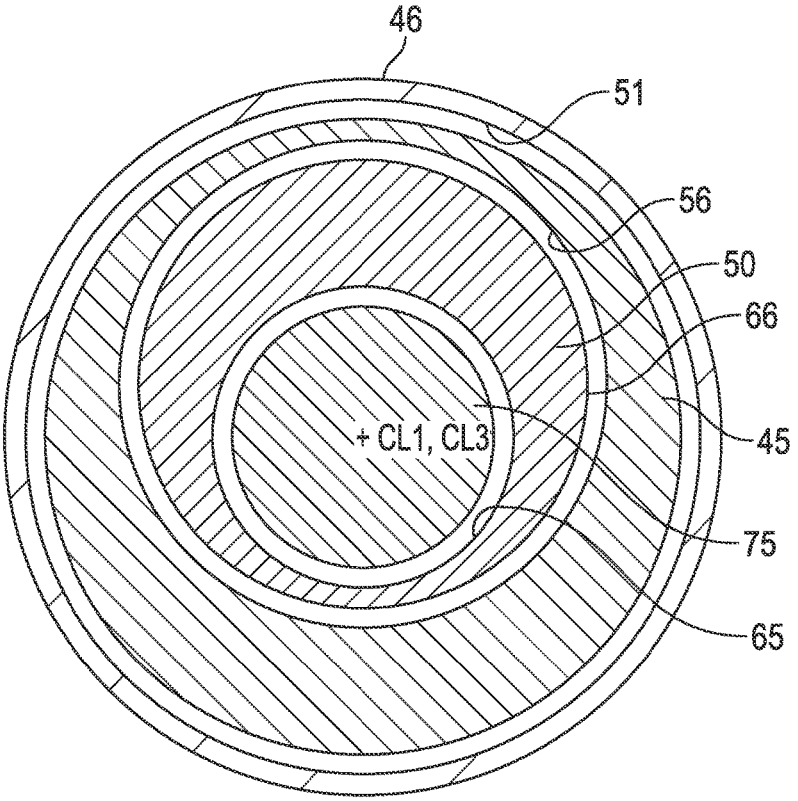
FIG. 3B shows an end view of the assembly of FIG. 3A.

Referring to FIGS. 2A-2B, a steerable drilling apparatus 160 is positioned near bit 150 in BHA 159. Steerable drilling assembly 160 comprises rotatable drive shaft 195 coupled to a rotating member 191 of drill string 120. Rotatable drive shaft 195 is coupled to a rotating steering shaft 75 by a coupling member 80. Rotating steering shaft 75 is, in turn, coupled to drill bit 150 for drilling the wellbore 126. As such, rotation of rotating, member 191 causes drill it 150 to rotate. In one example, rotating member 191 may be a drill string component that rotates at the same speed as the drill string. Alternatively, rotating member 191 may be the output shaft of a drilling motor disposed in drill string 120, such that rotating member 191 rotates at an increased RPM equal to the motor output RPM plus the drill string RPM.

As shown, orienting sleeve 50 is rotatably supported between a first orienting assembly 220A and a second orienting assembly 220B disposed within a substantially tubular housing 46. Housing 46 is substantially rotationally stationary in the wellbore during drilling. Rotatable steering shaft 75 is rotatably supported in orienting sleeve 50. Orienting sleeve 50 is also rotatable with respect to each orienting assembly 220A,B by actuation of orienting, sleeve actuator 226. Actuation of first orienting assembly 220A, second orienting assembly 220B, and orienting sleeve actuator 226 acts to orient steering shaft 75 and bit 150 in a desired three dimensional direction 252 to control the path of borehole 126.

First orienting assembly 220A and second orienting assembly 220B are disposed within housing 46 for controlling orienting sleeve 50. Steering shaft 75 rotates within orienting sleeve 50. Orienting sleeve 50 may be oriented to change the direction of steering shaft 75. Orienting sleeve 50 may provide contact bearing support to steering shaft 75 to limit the bending and bending stresses imposed on steering shaft 75, as described below.

With reference to FIGS. 3A-4B, orienting assembly 220A comprises a circular outer ring 45A that is rotatably supported by bearings 59, on a circular inner peripheral surface 51 of housing 46. Note in FIGS. 3B and 4B that the bearings 59 are omitted for clarity. Outer ring 45A has a circular inner peripheral surface 56A that is eccentric with respect to inner peripheral surface 51 of housing 46. Circular inner peripheral surface 56A of outer ring 45A rotatably supports orienting sleeve 50 through bearings 59. Similarly, orienting assembly 220B comprises a circular outer ring 45B that is rotatably supported by bearings 59, on circular inner peripheral surface 51 of housing 46. Outer ring 45B has a circular inner peripheral surface 56B that is eccentric with respect to inner peripheral surface 51 of housing 46. Circular inner peripheral surface 56B of outer ring 45B rotatably supports orienting sleeve 50 through bearings 59.

Figure 4A:
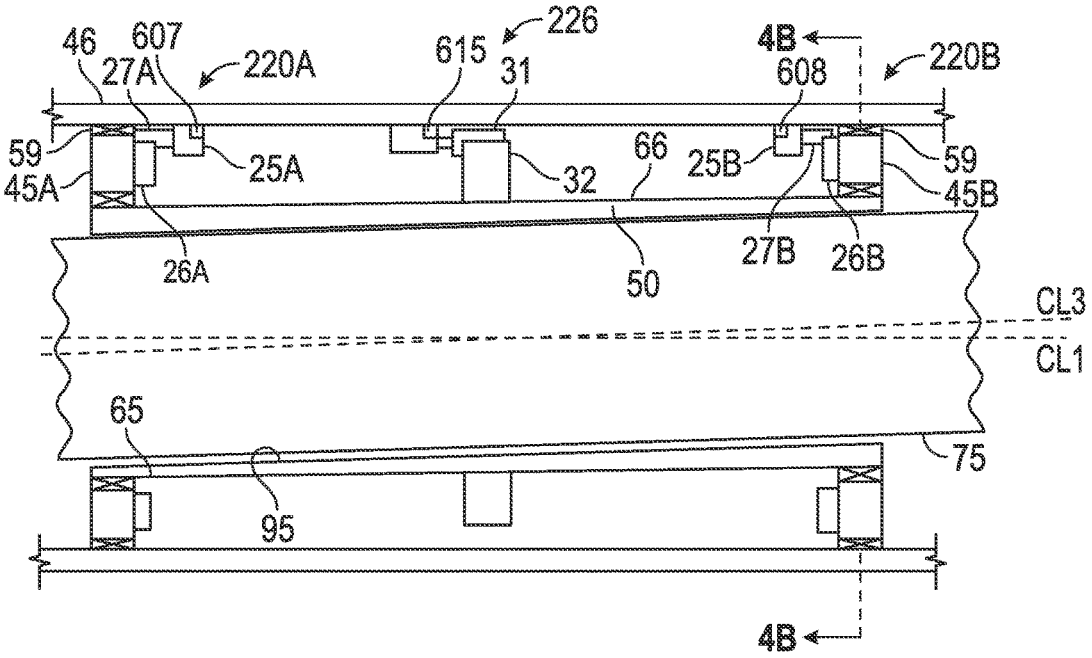
FIG. 4A shows the section of the steerable assembly of FIG. 3A with the rotation of the orienting assemblies and the orienting sleeve to create a deviation angle between the steering shaft and the housing.
Figure 4B:
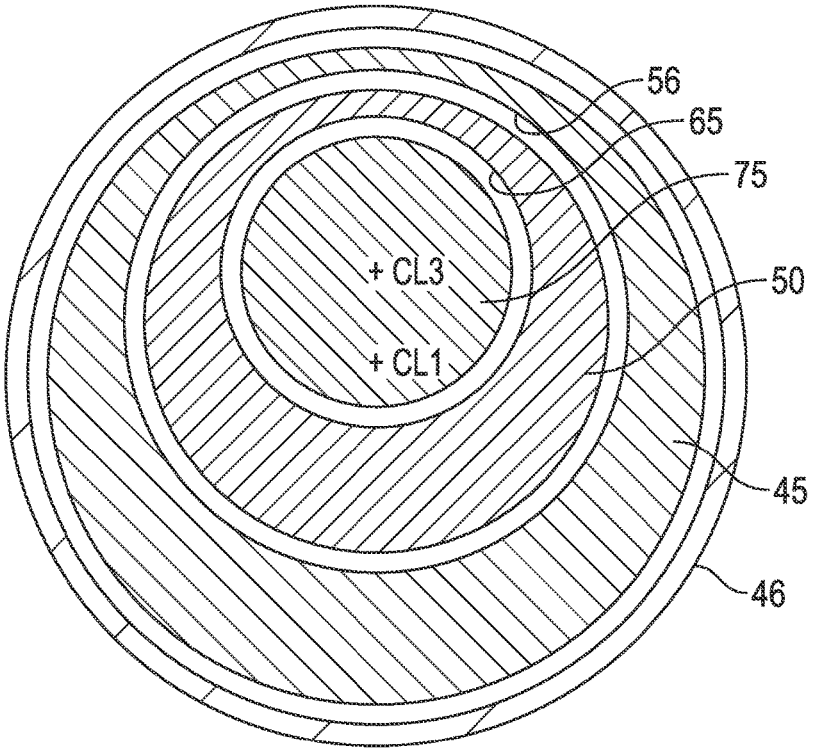
FIG. 4B is an end view of the assembly of FIG. 4A.

Orienting sleeve 50 has an inner peripheral surface 65 that defines an angled longitudinal circular bore 65 which has a centerline $CL_3$ that is angled with respect to a centerline $CL_2$ defined by the outer peripheral surface 66 of orienting sleeve 50 by a predetermined angle, θ (shown in FIG. 4A). By rotating outer rings 45A,B and the orienting sleeve 50 relative to each other, and relative to housing 46, shaft 75 may be inclined by angle, θ, such that bit 150 drills in a direction 152' with respect to the borehole centerline, $CL_1$, of housing 46. In the embodiment shown, orienting assemblies 220A,B also comprise a motors 25A,B driving a spur gears 27A,B that engages ring gears 26A,B. Ring gears 26A,B are attached to outer rings 45A,B and controllably drive outer rings 45A,B under the direction of a downhole controller 601, discussed below.

Orienting sleeve 50 may be controllably rotated relative to housing 46 and each outer ring 45A,B by orienting sleeve actuator 226. Orienting sleeve actuator 226 comprises a motor 30 driving a spur gear 31 that is operatively engaged with a ring gear 32 attached to outer peripheral surface 66 of orienting sleeve 50. Motor 30 controllably rotates deflection sleeve 50 under the control of controller 601. Motors 25A, 25B, and 30 may be electric motors, hydraulic motors, or combinations thereof. Such motors may incorporate rotational sensors, 607, 608, and 615, respectively, for accurate determination of the rotational angular orientation of the outer rings 45A,B and deflection sleeve 50 relative to housing 46.

The rotational orientation of drilling shaft 75 may be referenced as a toolface angle with respect to the gravitational high side of an inclined wellbore. Alternatively, in a substantially vertical wellbore, the reference may be to a north reference, for example magnetic, true, or grid north. As used herein, the toolface angle is the angle between the discussed reference, high side or north, and the plane containing the angled drilling shaft.

As indicated above, orienting sleeve 50 may provide contact bearing support to steering shall 75 to limit the bending and bending stresses imposed on steering shaft 75. In one example, the inner peripheral surface 65 of orienting sleeve 50 may be coated with an abrasion resistant coating 95 to act as a wear resistant bearing surface. Such a coating 95 may extend over the entire length of orienting sleeve 50. Alternatively, the coating 95 may extend over predetermined portions of inner peripheral surface 65. Abrasion resistant coating 95 may comprise at least one of, a natural diamond coating, a synthetic diamond coating, a tungsten coating, a tungsten carbide coating, and combinations thereof. Similarly, at least some portions of steering shaft 75 may be coated. For example, the peripheral surface of steering shaft 75 may be coated where they are operationally juxtaposed with coated bearing surfaces on the inner peripheral surface of 65 of orienting sleeve 50.

Figure 5:
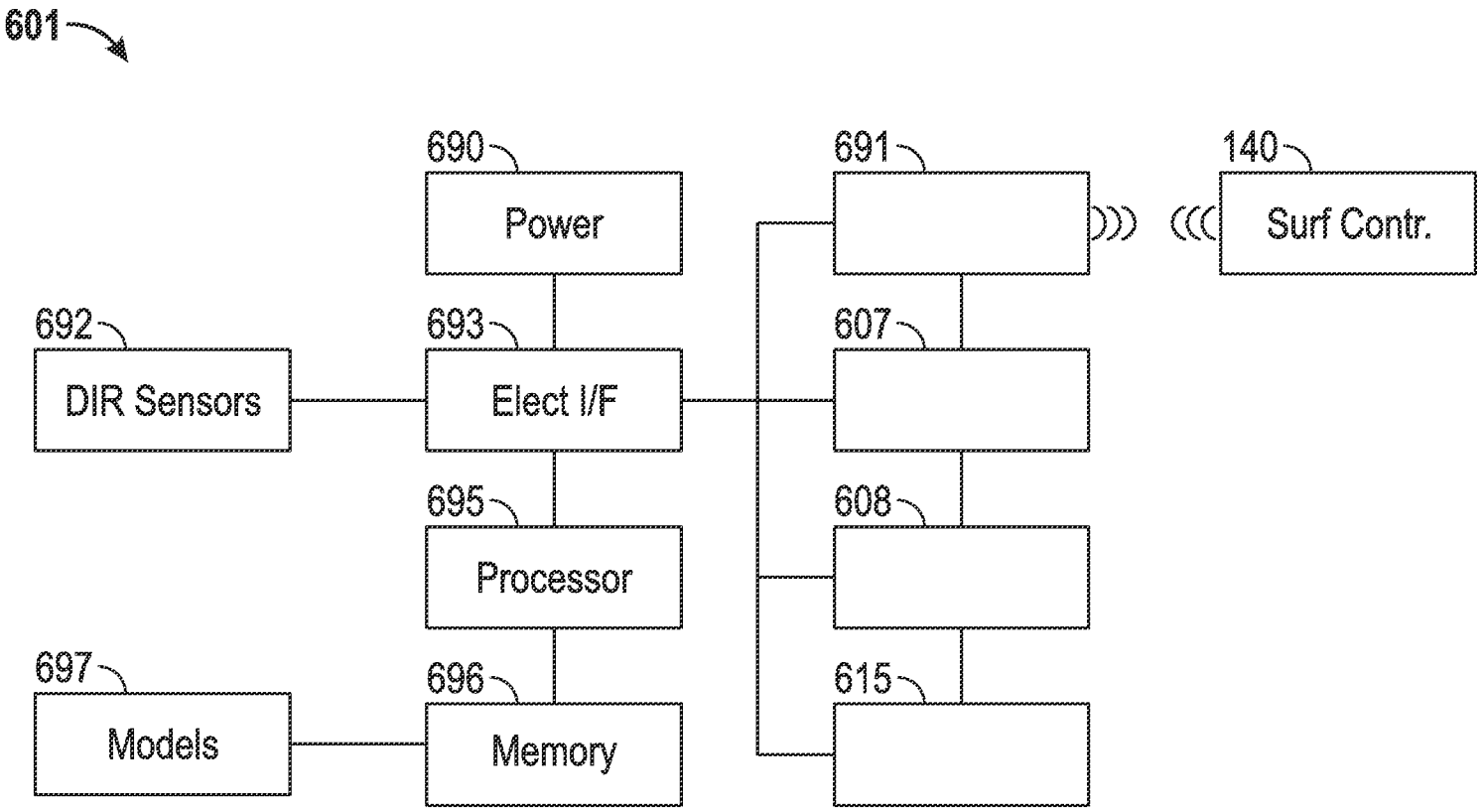
FIG. 5 is a block diagram of one embodiment of a steerable drilling apparatus.

Downhole controller 601, see FIG. 5, may be located in housing 46 to control the operation of steerable assembly 160. Controller 601 may comprise a processor 695 in data communications with any of the orienting assemblies 220A,B and 226 described above. In one embodiment, the deviation angle of drilling shaft 75 may be controlled by rotating the orientation sleeve 50 described above, and the toolface angle of drilling shaft 75 may be controlled with respect to the housing 46 by the proper rotation of outer rings 45A,B, thus orienting the drill, bit 150 to drill along a desired path.

In one example well trajectory models 697 may be stored in a memory 696 that is in data communications with a processor 695 in the electronics 601. Directional sensors 692 may be mounted in housing 46 or elsewhere in the BHA, and may be used to determine the inclination, azimuth, and highside of the steering assembly 160. Directional sensors may include, but are not limited to: azimuth sensors, inclination sensors, gyroscopic sensors, magnetometers, and three-axis accelerometers. Depth measurements may be made at the surface and/or downhole for calculating the location of steering assembly 160 along the wellbore 26. If depth measurements are made at the surface, they may be transmitted to the downhole assembly using surface transmitter 180 described above with reference to FIG. 1. In operation, electronic interface circuits 693 may distribute power from power source 690 to one, or more, of directional sensors 692, processor 695, downhole transmitter 133, first orienting assembly 220, second orienting assembly 225, and deflection sleeve actuator assembly 226. In addition, electronic interface circuits 693 may transmit and/or receive data and command signals from directional sensors 692, processor 695, and telemetry system 691. Angular rotation sensors 607, 608 and 615 may be used to determine the rotational positions of outer ring 45A, outer ring 45B, and orienting sleeve 75 relative to housing 46. Power source 690 may comprise batteries, a downhole generator/alternator, and combinations thereof. In one embodiment, models 697 may comprise directional position models to control the steering assembly to control the direction of the wellbore along a predetermined trajectory. The predetermined trajectory may be 2-dimensional and/or 3-dimensional. In addition models 697 may comprise instructions that evaluate the readings of the directional sensors to determine when the well path has deviated from the desired trajectory. Models 697 may calculate and control corrections to the toolface and drilling shaft angle to make adjustments to the well path based on the detected deviations. In one example, models 697 may adjust the well path direction to move back to an original planned predetermined trajectory. In another, example, models 697 may calculate a new trajectory from the deviated position to the target, and control the steering assembly to follow the new path. In one example, the measurements, calculations, and corrections are autonomously executed downhole. Alternatively, direction sensor data may be transmitted to the surface, corrections calculated at the surface, and commands from the surface may be transmitted to the downhole tool to alter the settings of the steering assembly.

Numerous variations and modifications will become apparent to those skilled in the art. It is intended that the following claims be interpreted to embrace all such variations and modifications.

The invention claimed is:

1. A steerable well drilling apparatus comprising:

a tubular housing having a cylindrical inner peripheral surface;

a first orienting assembly and a second orienting assembly spaced apart along the inner peripheral surface of the housing;

an orienting sleeve rotatably supported between the first orienting assembly and the second orienting assembly, the orienting sleeve having an angled bore wherein a first longitudinal axis of the angled bore is inclined by a predetermined angle to a second longitudinal axis referenced to a cylindrical outer peripheral surface of the orienting sleeve;

a rotatable steering shaft extending axially through and rotatably supported along the angled bore to control rotatable steering shaft bending, the rotatable steering shaft operably coupled to a drill bit for drilling a well;

an orienting sleeve actuator operably coupled to the orienting sleeve to controllably rotate the orienting sleeve with respect to the housing; and a controller operatively coupled to the first orienting assembly, the second orienting assembly, and the orienting sleeve actuator to controllably adjust the steering direction of the rotatable steering shaft, wherein the first orienting assembly and the second orienting assembly each comprise:

a circular outer ring having a circular inner peripheral surface that is eccentric with respect to the cylindrical inner peripheral surface of the housing; and a motor operatively coupled to the circular outer ring and to the controller, wherein the controller operates to actuate the motor.

2. The apparatus of claim 1 wherein at least one of the steering shaft and the inner peripheral surface of the orienting sleeve is at least partially coated with an abrasion resistant coating.

3. The apparatus of claim 2 wherein the abrasion resistant coating is chosen from the group consisting of: a natural diamond coating, a synthetic diamond coating, a tungsten coating, a tungsten carbide coating, and combinations thereof.

4. The apparatus of claim 1 wherein the controller comprises a processor in data communication with a memory.

5. The apparatus of claim 1, wherein the first orienting assembly engages the orienting sleeve at a first bearing surface and the second orienting assembly engages the orienting sleeve at a second bearing surface the first bearing surface being longitudinally offset from the second bearing.

6. The apparatus of claim 1, wherein the first orienting assembly engages the orienting sleeve at a first bearing surface and the second orienting assembly engages the orienting sleeve at a second bearing surface the first bearing surface being longitudinally offset from the second bearing surface.

7. A method for steering a well comprising:

positioning a tubular housing having a cylindrical inner peripheral surface in a drill string in a well;

positioning a first orienting assembly and a second orienting assembly spaced apart along the inner peripheral surface of the housing;

rotatably supporting an orienting sleeve between the first orienting assembly and the second orienting assembly, the orienting sleeve having an angled bore, wherein a first longitudinal axis of the angled bore is inclined by a predetermined angle to a second longitudinal axis referenced to a cylindrical outer peripheral surface of the orienting sleeve;

extending a rotatable steering shaft axially through and rotatably supported along the angled bore to control rotatable steering shaft bending, the rotatable steering shaft operably coupled to a drill bit for drilling a well; and controllably adjusting the rotation of the first orienting assembly, the second orienting assembly, and the orienting sleeve to adjust the steering direction of the rotatable steering shaft, wherein the first orienting assembly and the second orienting assembly each comprise:

a circular outer ring having a circular inner peripheral surface that is eccentric with respect to the cylindrical inner peripheral surface of the housing; and a motor operatively coupled to the circular outer ring and to the controller, wherein the controller operates to actuate the motor.

8. The method of claim 7 further comprising coating at least one of the steering shaft and the inner peripheral surface of the orienting sleeve at least partially with an abrasion resistant coating.

9. The method of claim 8 wherein the abrasion resistant coating is chosen from the group consisting of: a natural diamond coating, a synthetic diamond coating, a tungsten coating, a tungsten carbide coating, and combinations thereof.

10. The method of claim 7 wherein the controller comprises a processor in data communication with a memory.

* * * * *